US008448414B2

(12) United States Patent
Wipf

(10) Patent No.: US 8,448,414 B2
(45) Date of Patent: May 28, 2013

(54) METHOD AND APPARATUS FOR PACKAGING PRODUCTS, AND ASSOCIATED PACKAGE BLANK

(75) Inventor: Alfred Wipf, Jestetten (DE)

(73) Assignee: Robert Bosch GmbH, Stuttgart (DE)

( * ) Notice: Subject to any disclaimer, the term of this patent is extended or adjusted under 35 U.S.C. 154(b) by 1442 days.

(21) Appl. No.: 11/630,273

(22) PCT Filed: Apr. 12, 2005

(86) PCT No.: PCT/DE2005/000652

§ 371 (c)(1),
(2), (4) Date: Dec. 20, 2006

(87) PCT Pub. No.: WO2006/000172

PCT Pub. Date: Jan. 5, 2006

(65) Prior Publication Data

US 2008/0028731 A1 Feb. 7, 2008

(30) Foreign Application Priority Data

Jun. 24, 2004 (CH) ..... 1062/04

(51) Int. Cl.
*B65B 43/08* (2006.01)

(52) U.S. Cl.
USPC ..... 53/456; 53/452; 53/461

(58) Field of Classification Search
USPC ..... 53/452, 456–459, 461–462
See application file for complete search history.

(56) References Cited

U.S. PATENT DOCUMENTS

| | | | | |
|---|---|---|---|---|
| 1,985,075 | A | 12/1934 | Bird | |
| 3,218,776 | A * | 11/1965 | Cloud | 53/453 |
| 3,472,723 | A * | 10/1969 | Lemelson | 156/500 |
| 3,481,100 | A * | 12/1969 | Bergstrom | 53/433 |
| 3,555,776 | A | 1/1971 | Nigrelli et al. | |
| 3,577,700 | A * | 5/1971 | Bippus et al. | 53/453 |
| 3,750,362 | A * | 8/1973 | Kishpaugh et al. | 53/433 |
| 3,851,441 | A * | 12/1974 | Marchand | 53/116 |
| 4,424,658 | A | 1/1984 | Focke | |
| 4,449,350 | A * | 5/1984 | Sanford | 53/412 |
| 4,830,863 | A * | 5/1989 | Jones | 426/118 |
| 5,661,948 | A | 9/1997 | Odenthal | |
| 5,727,367 | A * | 3/1998 | Cahill et al. | 53/462 |
| 6,105,340 | A * | 8/2000 | Draghetti | 53/415 |
| 6,684,606 | B1 * | 2/2004 | Draghetti | 53/415 |
| 7,134,257 | B2 * | 11/2006 | Focke et al. | 53/234 |

FOREIGN PATENT DOCUMENTS

| | | | |
|---|---|---|---|
| DE | 78 28 046 | U1 | 1/1979 |
| DE | 80 31 041 | U1 | 3/1981 |
| DE | 297 16 528 | U1 | 2/1998 |
| EP | 0 714 829 | A2 | 6/1996 |
| FR | 2 531 037 | A2 | 2/1984 |
| FR | 2 697 499 | A1 | 5/1994 |
| WO | WO 03/042044 | A1 | 5/2003 |

* cited by examiner

*Primary Examiner* — Christopher Harmon
(74) *Attorney, Agent, or Firm* — Michael Best & Friedrich LLP

(57) ABSTRACT

A method for packaging products including the steps of delivering an initial packaging material to a package assembly line; reshaping the initial packaging material into self-supporting initial packages; packaging the products in these initial packages; delivering second packaging material to the package assembly line and packaging the initial packages, filled with the products, in the second packaging material. The initial packaging material is delivered in the form of strip stock which is converted in the package assembly line into individual package blanks; and reshaped into the initial packages. This makes packaging possible in the shortest possible time, with nevertheless high flexibility.

17 Claims, 3 Drawing Sheets

METHOD AND APPARATUS FOR PACKAGING PRODUCTS, AND ASSOCIATED PACKAGE BLANK

CROSS-REFERENCE TO RELATED APPLICATIONS

This application is a 35 USC 371 application of PCT/DE 2005/000652 filed on Apr. 12, 2005.

BACKGROUND OF THE INVENTION

1. Field of the Invention

The invention relates to a method and an apparatus for packaging products and to an associated package blank used therein.

2. Description of the Prior Art

Automatic packaging apparatuses are known in which products, especially parcelled goods such as cookies, are first placed in self-supporting initial packages and then packed jointly with their initial package into a bag package. The initial package provides for stability and protects the product. The second package, or in other words the foil or film package, meets the necessary hygiene regulations.

As the initial packaging material, cardboard blanks are typically used, which are taken from a stack and then folded and glued in the packaging apparatus. One such apparatus is known from German Patent Disclosure DE-A 195 29 585.

By means of such cardboard blanks, the most various initial packages can be shaped. For instance, containers can be created that are closed completely, in other words on all sides, as is shown in DE-A 195 29 585 and International Patent Disclosure WO 98/15461. However, U-shaped, C-shaped or G-shaped containers can also be formed. Depending on the type of cuts and the bending edges or bending grooves, the blanks can be folded in various ways. Further examples of this are disclosed in International Patent Disclosure WO 00/38997 and U.S. Pat. No. 5,549,202.

Cardboard blanks are also known that serve as packages for so-called blister packs, i.e. holders of pharmaceutical products, such as pills, capsules, and tablets. These cardboard blanks are reshaped into small billfolds, as known for instance from WO 02/100736 and German Utility Model DE-A 201 05 928 U.

For producing packages that are not self-supporting, it is also known to use strip stock, especially thin films or foils. European Patent Disclosure EP-A 1 038 780 is one example of this.

SUMMARY OF THE INVENTION

It is an object of the invention to create a method and an apparatus which make it possible to package products in self-supporting initial packages and second packages that envelop the initial packages in the shortest possible time and which nevertheless have high flexibility.

It is a further object of the invention to create a package blank which enables manufacturing a package as inexpensively as possible.

In the method of the invention for packaging products, strip stock which is delivered from a roll to the package assembly line is used as the initial packaging material. The strip stock delivered is machined, and in particular cut to size, stamped, provided with scoring lines or grooves, and printed. The blanks thus created are reshaped into individual self-supporting initial packages by folding over individual parts of them, in particular folding them over upright or laterally. These initial packages can be equipped or filled with products and provided with a second package. The products can be dispensed or disposed either before, during or after the reshaping of the blanks.

The products are typically parcelled goods which are placed individually or in groups on a bearing face of the initial packages. However, they may themselves already be packaged. In addition, different products can be placed in this same initial package, or still other products, such as printed package inserts, can be put in place before the second package is applied.

The initial packaging material is preferably embodied as stiffer than the second packaging material. This assures adequate stability of the initial package and adequate protection for the products. Preferably, the initial packaging material is made of a cardboard.

With the method and the apparatus according to the invention, high packaging speeds can be attained. Typically attainable values are 400 packages per minute, compared to 200 packages per minute that can typically be achieved using stacked package blanks.

The invention also makes a great variety of variation possible in terms of the type and shape of package and also makes correspondingly great flexibility possible. Since the basic material is strip stock, not a blank that already predetermines the shape of the package, the most various shapes can be achieved in the same machine; only the cuts and separations of the strip stock have to be adapted to the particular packaging task.

The apparatus and method according to the invention are especially suitable for making open initial packages, or so-called trays.

In a preferred embodiment, the initial package has a base and at least one region which is folded upward at a front or a back end, in terms of the conveying direction, of the base and forms front or back walls as applicable. Preferably there are also side walls that extend in the conveying direction. The embodiment of the front and back walls enables better fixation of the products, before they are packaged for the second time.

In a further preferred embodiment, the package blank has bending grooves or weakened points and slits, and at least one of these slits extends over only part of the width of the side wall and over only part of the width of the base. One of the bending grooves is located adjacent to the at least one slit, and this bending groove extends at an angle, preferably perpendicularly, to at least one slit. As a result, ribs can be folded upward that form a boundary and hence a fixation for the products, without requiring that faces folded upward have to be glued together. This saves both material and time. If the slits extend parallel and adjacent to the front and back edge of the package blank, then it is simple to form front and back stops for the products. It is also possible, in addition or instead of these slits near the edge, to locate such slits at an arbitrary point along the length of the package blank. As a result, separation ribs for the individual products can be formed inside the initial package in a simple way and without having to introduce additional material.

Such package blanks can also be used in other packaging machines. They need not necessarily be in the form of strip stock but instead can be used in the form of stacked goods.

The invention is especially suited to packaging pharmaceutical products, such as blister packs of tablets. In this latter case, the initial package is preferably a small billfold, that is, a so-called wallet. However, the invention is especially suitable also for packaging parcelled goods, for instance in the food field. If initial packages with front and back stops are used, then optimal packaging especially of cookies or crackers that stand on edge can be achieved.

It is also advantageous that the use of strip stock makes it possible to print the material before, during or after the reshaping of the initial package.

A further advantage is that upon a change in the type of strip stock or a change in the type of product, the apparatus of the invention can be converted quickly and simply.

Further advantageous variants and embodiments are disclosed.

BRIEF DESCRIPTION OF THE DRAWINGS

The invention will be more fully described below with reference to the drawings, in which.

DESCRIPTION OF THE PREFERRED EMBODIMENTS

Figure 1:
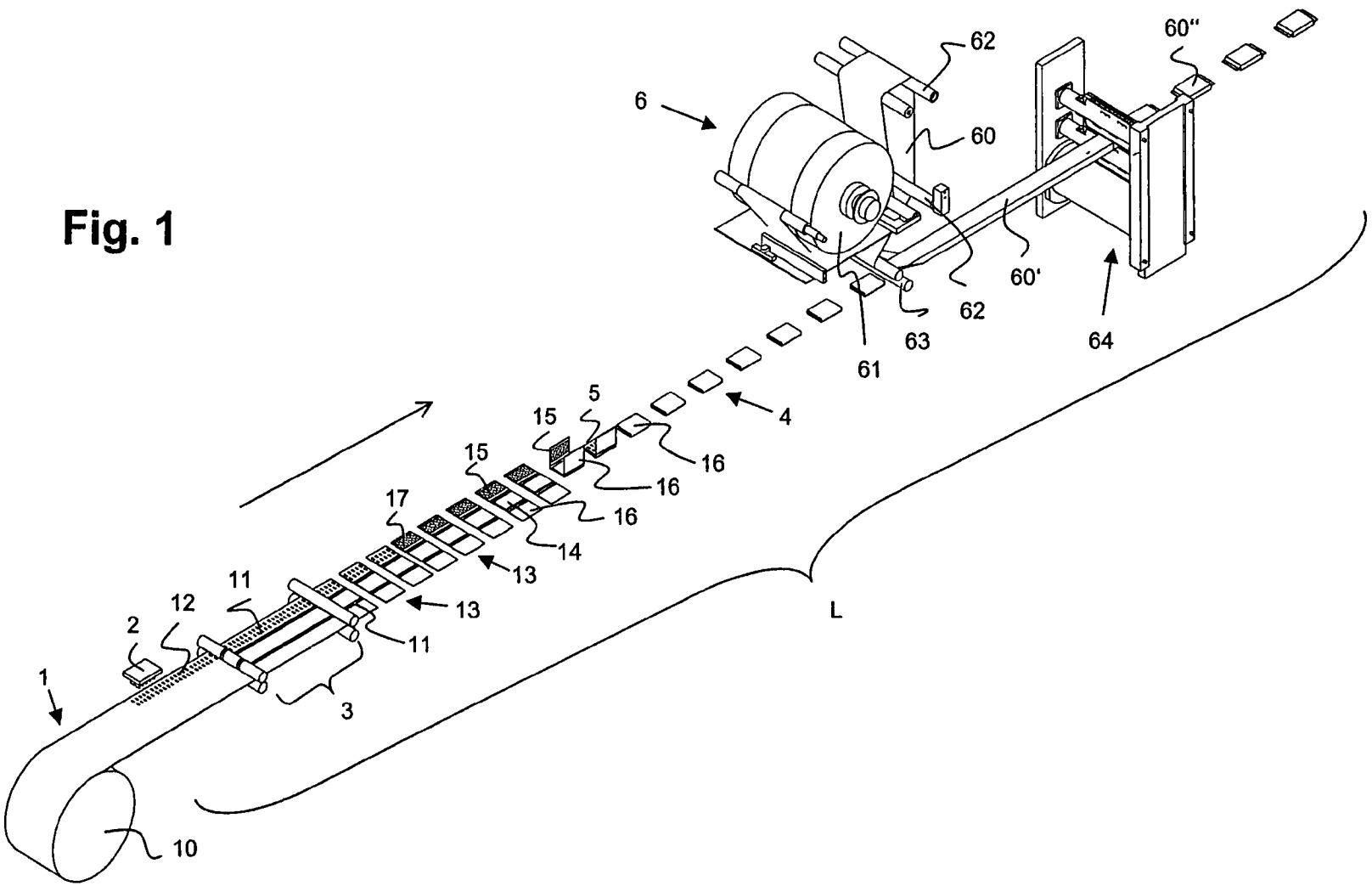
FIG. 1 is a schematic illustration of an apparatus according to the invention.

In FIG. 1, an apparatus according to the invention for packaging products in an initial package and in a second package is shown. An initial packaging material 1 is wound up on a roll of material 10 and is drawn from the roll of material in the form of a running length or strip, using known means not shown here, and delivered to a package assembly line L. As the initial packaging material, a cardboard or other material with sufficient rigidity is preferably used. The material should be suitable for forming self-supporting initial packages.

Even shortly after being drawn from the roll of material 10, the material can be provided for the first time with an initial printing 12 by means of a first initial printing unit 2. The strip stock is then guided through a cutting and grooving unit 3, in which it is provided with the cuts or bending grooves 11 or weakened places required for the reshaping. In the example shown here, bending grooves 11 are made extending only in the conveying direction, and the individual first package blanks 13 are cut to length. The bending grooves 11 assure that the cardboard blank is capable of being bent at the desired points in the ensuing bending operation. Instead of the bending grooves, scores or weakened points or lines made in the material, or other means which facilitate bending at intended points, may be used.

The package blank 13 in this example has a base 14, a first side part 15, and a second side part 16. In the example shown here, these three parts have approximately the same surface areas. However, this is not absolutely necessary.

The package blank 13 can now be filled, or as shown here, it can be printed for a second time. A layer of glue can also be applied. The corresponding printing unit is no longer shown. However, the second printing is identified by reference numeral 17.

In an ensuing folding unit, also not shown here, the two side parts 15, 16 are folded upward. The folding axes preferably extend parallel to the conveying direction, and thus parallel to the longitudinal seam, described hereinafter, of the second package. As the folding units, known means may be used. The first side part 15 is then placed against the base 14 and in this case is then occupied by a product 5, in this case a blister pack. Next, the second side part 16 is folded down onto the first side part 15. The products 5 can be delivered by known means. They can be poured into the initial package. However, they are preferably delivered via known chutes or so-called pick-and-place robots, and especially by means of a Delta robot.

The initial package thus formed is now delivered without interruption to the production line for a second package unit. The delivery is preferably done by means of the same conveyor that was already used during the cutting to size and reshaping. It is also possible to use a separate delivery conveyor of a known kind, such as a belt conveyor. In that case, the conveyor is preferably driven synchronously with the first conveyor and also with the conveyor, described below, of the second package. The package assembly line L preferably extends in a straight line and horizontally.

The second packaging unit is preferably a horizontal bag package-making machine 6 of a known type. Second packaging material 60, preferably a thin film or foil wound on a roll of material 61, is delivered to a folding unit 63 via draw-off and deflection rollers 62. There, the strip stock is folded into a packaging tube 60', and the products 5 packaged in the initial package 4 are introduced into the tube 60'. The filled packaging tube 60' is longitudinally sealed, which is not shown here. It is also passed through a transverse sealing and separating unit 64, where transverse sealing seams are welded into the tube 60', and the individual bag packages 60" thus created are either separated from one another or at least provided with perforations for later separation. The bag packages may additionally be provided with some aid in opening them.

In the drawings described below, further preferred embodiments of initial packages are shown. In the above-described apparatus, these initial packages can be produced and processed uninterruptedly from a length of material on a roll. However, they can also be made in advance and used as stacked goods in a packaging machine of a known kind.

In FIGS. 2*a* through 2*d*, a second package blank 7 is shown. It is embodied essentially rectangularly and has a base 70, a first side wall 71, a second side wall 72, a front wall 73, and a back wall 74. The terms "front" and "back", or "rear", are in terms of the applicable conveying direction of the blank. This conveying direction is indicated in the drawing by an arrow. Preferably, the front edge of the front wall 73 and the rear edge of the back wall 74 extend at least approximately perpendicular to the conveying direction, and the side edges of the side walls 71, 72 extend approximately parallel to the conveying direction. Bending grooves are also present; two bending grooves 75, 76 extend transversely to the conveying direction and demarcate the front and back walls 73, 74 from the base 70, and two longitudinal bending grooves 77, 78 extend parallel to the conveying direction and on the one hand divide the side walls 71, 72 from the base 70 and on the other also extend along the front and back walls, respectively. The front and back walls 73, 74 are preferably embodied as shorter, transversely to the conveying direction, than the remainder formed by the base 70 and the side walls 71, 72. Corresponding parts can be cut off and carried away when the strip stock is cut to size. The front and back walls 73, 74 are also preferably provided with a central cutout or V-shaped notch 79 and thus are not completely closed.

Figure 2A:
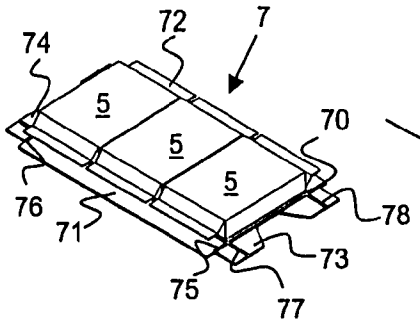
FIGS. 2*a* through 2*d* are schematic illustrations of folding an initial package blank in four steps, in a first embodiment.

In the position shown in FIG. 2*a*, the package blank rests flat on the conveyor, not shown, and products 5 have already been placed on the base 70. Here, the products 5 have prepackaging in the form of bag packages. However, this is meant solely as an example.

Figure 2B:
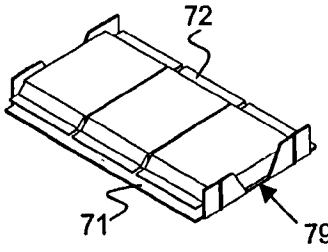

In FIG. 2*b*, which represents a subsequent step in production, the front and back walls 73, 74 are folded upward. This folding upward is done by known means. For instance, lateral folders or folders engaging from above or below may be located along the conveying route.

Figure 2C:
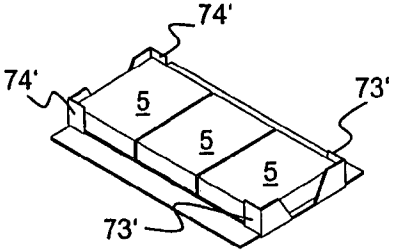

Next, the side wings 73', 74' of the front and back walls 73, 74 are folded laterally inward, and glue is applied to their outer surfaces. This is likewise done by known means. This situation is shown in FIG. 2*c*.

Figure 2D:
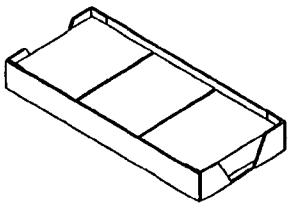

Finally, the side walls 71, 72 are folded upward and pressed against the glued side wings 73', 74', as can be seen in FIG. 2*d*.

This package has the advantage that the front and back walls 73, 74 serve as a brace and a stop for the products 5 located in the package. It is also possible for only the front or only the back wall to be folded upward. In addition, a lid can also be placed on a side wall and finally folded over, extending parallel to the base, and optionally fixed in that position.

Figure 3A:
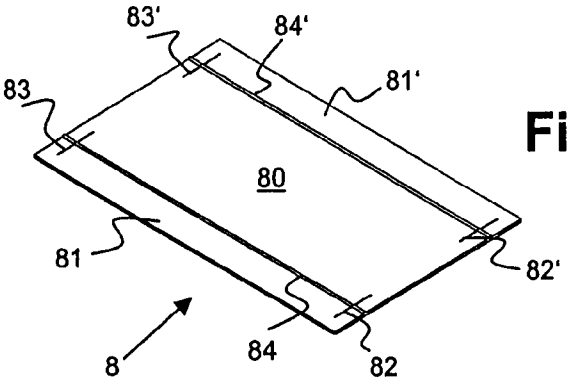
FIGS. 3*a* through 3*c* are schematic illustrations of folding an initial package blank in three steps, in a second embodiment.
Figure 3B:
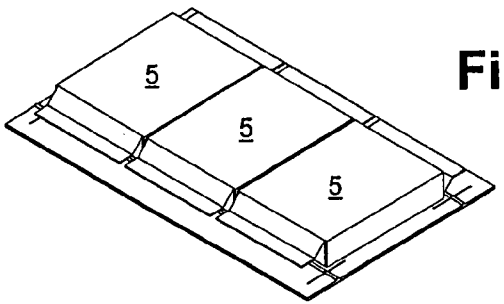
Figure 3C:
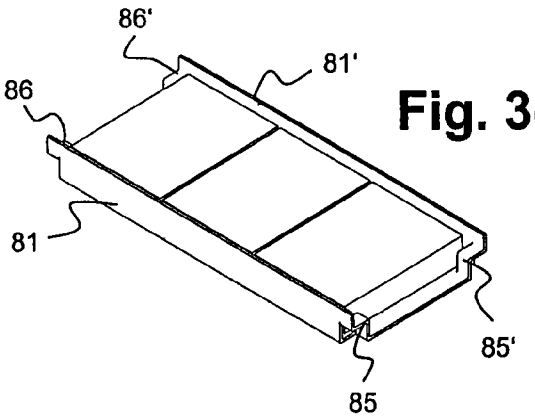

In FIGS. 3*a* through 3*c*, a third embodiment of an initial package is shown. The package blank 8 shown in FIG. 3*a* again has a base 80 and two side walls 81, 81'. In addition, there are bending grooves 84, 84', extending longitudinally or in other words in the conveying direction and parallel to the side edge and extending over the entire length of the blank 8.

Transversely to these bending grooves 84, 84' and parallel to the front and rear edge of the blank 8, there are a first and a second front slit 82, 82' and a first and second rear slit 83, 83'. These slits 82, 82', 83, 83' are located adjacent to the respective front and rear edge, and they extend over only part of the width of the base 80 and only part of the width of the side walls 81, 81'.

In FIG. 3*b*, once again products 5 have been placed on the base 80. In FIG. 3*c*, the slits 82, 82', 83, 83' have now been pressed upward by means of indenting means of a known type, for example by means of folders engaging the conveying route obliquely from below, and as a result, thanks to the bending grooves 84, 84', ribs 85, 85', 86, 86' have now been formed. These ribs 85, 85', 86, 86' form front and rear stops, respectively, for the products 5. Simultaneously, or beforehand or afterward, the side walls 81, 81' can be folded upward by known means. All of these can also be folded over or folded upward by this same means.

This embodiment has the advantage that no adhesive is necessary, and that furthermore work can be done with a minimum number of cuts and bending grooves. In addition, rectangular cardboard blanks can be used without having to cut parts of them away and carry them away as waste.

Figure 4:
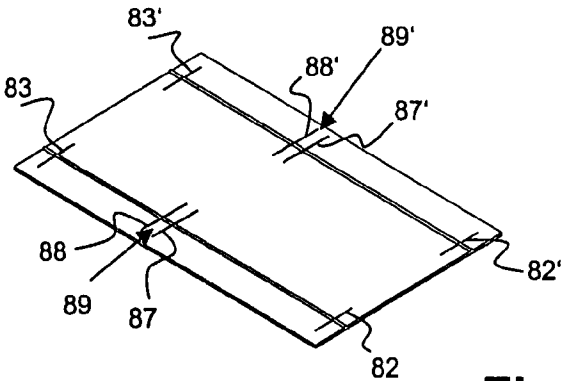
FIG. 4 shows a variant corresponding to FIG. 3*a*.

In FIG. 4, a variant of this embodiment is shown. In addition, middle slits 87, 87', 88, 88' are also present, which are capable of forming a middle rib 89. This middle rib 89 can be located at arbitrary points, and several such ribs can also be located inside the blank 8. Moreover, it can be used in addition to or instead of the slits 82, 82', 83, 83' described above, which are close to the edges.

It is understood that the apparatus and the method according to the invention can also be employed using different blanks.

The foregoing relates to a preferred exemplary embodiment of the invention, it being understood that other variants and embodiments thereof are possible within the spirit and scope of the invention, the latter being defined by the appended claims.

The invention claimed is:

1. In a method for packaging products, the method having the following steps:

delivering an initial packaging material in the form of strip stock to a conveyor in a package assembly line;

converting the strip stock on the conveyor into individual package blanks;

reshaping the initial packaging blanks on the conveyor into open, self-supporting initial packages;

packaging the products in the open, self-supporting initial packages;

delivering second packaging material to a bag-making machine located in the package assembly line;

delivering the open, self-supporting initial packages, filled with the products, to the bag-making machine by means of the conveyor; and packaging the initial packages, filled with the products, in the second packaging material.

2. The method as defined by claim 1, wherein an initial packaging material is used which is stiffer than the second packaging material.

3. The method as defined by claim 1, wherein the initial packaging material is cardboard.

4. The method as defined by claim 2, wherein the initial packaging material is cardboard.

5. The method as defined by claim 1, wherein the second packaging material is delivered in the form of strip stock and is reshaped into a bag package.

6. The method as defined by claim 2, wherein the second packaging material is delivered in the form of strip stock and is reshaped into a bag package.

7. The method as defined by claim 3, wherein the second packaging material is delivered in the form of strip stock and is reshaped into a bag package.

8. The method as defined by claim 1, further comprising forming bending grooves or weakened places in the initial packaging material in the package assembly line.

9. The method as defined by claim 1, further comprising folding the package blanks to create at least one front or back stop, with respect to their conveying direction, for the products located in the initial package.

10. The method as defined by claim 9, wherein the package blanks are folded such that the initial packages have at least one base, at least one front or back stop, and at least two side walls extending parallel to the conveying direction.

11. The method as defined by claim 9, further comprising cutting at least one slit into the initial packaging material, each at least one slit extending over only part of the width of a future side wall and over only part of the width of a future base of the initial package; and forming at least one bending groove in the packaging material extending at an angle, preferably of 90°, to each at least slit.

12. The method as defined by claim 10, further comprising cutting at least one slit into the initial packaging material, each at least one slit extending over only part of the width of a future side wall and over only part of the width of a future base of the initial package; and forming at least one bending groove in the packaging material extending at an angle, preferably of 90°, to each at least slit.

13. The method as defined by claim 11, wherein the at least one slit is cut at least approximately parallel to an end edge of the package blank; and wherein the at least one bending groove is made at least approximately perpendicular to this slit.

14. The method as defined by claim 12, wherein the at least one slit is cut at least approximately parallel to an end edge of the package blank; and wherein the at least one bending groove is made at least approximately perpendicular to this slit.

15. The method as defined by claim 5, wherein the strip stock is a film or foil.

16. The method as defined by claim 6, wherein the strip stock is a film or foil.

17. The method as defined by claim 7, wherein the strip stock is a film or foil.

* * * * *

UNITED STATES PATENT AND TRADEMARK OFFICE

CERTIFICATE OF CORRECTION

PATENT NO. : 8,448,414 B2
APPLICATION NO. : 11/630273
DATED : May 28, 2013
INVENTOR(S) : Alfred Wipf It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1295 days.

Signed and Sealed this
Eighth Day of September, 2015

Michelle K. Lee

Michelle K. Lee
*Director of the United States Patent and Trademark Office*